US006814135B2

(12) United States Patent
Narahara et al.

(10) Patent No.: US 6,814,135 B2
(45) Date of Patent: Nov. 9, 2004

(54) STACKED-TYPE EVAPORATOR

(75) Inventors: Mitsunari Narahara, Tokyo (JP); Yoshihiro Sasaki, Tokyo (JP); Kazuhiro Kojima, Tokyo (JP); Toru Asanuma, Tokyo (JP); Yoshiaki Koga, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 27 days.

(21) Appl. No.: 09/962,133

(22) Filed: Sep. 26, 2001

(65) Prior Publication Data

US 2003/0070797 A1 Apr. 17, 2003

(30) Foreign Application Priority Data

Sep. 27, 2000 (JP) ..... P. 2000-294260

(51) Int. Cl.[7] ..... F28F 9/02
(52) U.S. Cl. ..... 165/153; 165/174; 165/176
(58) Field of Search ..... 165/152, 153, 165/176

(56) References Cited

U.S. PATENT DOCUMENTS 5,042,577 A * 8/1991 Suzumura ..... 165/153
6,070,428 A * 6/2000 Higashiyama et al. ..... 62/525
6,230,787 B1 * 5/2001 Koga et al. ..... 165/41

FOREIGN PATENT DOCUMENTS

| | | | |
|---|---|---|---|
| JP | 62-798 | 1/1987 | |
| JP | 7-12778 | 3/1995 | |
| JP | 9-318195 | 12/1997 | |
| JP | 2000-105023 A * | 4/2000 | ..... F25B/39/02 |
| JP | 2000-146362 | 5/2000 | |
| JP | 2000-193342 | 7/2000 | |
| JP | 2001-21233 | 1/2001 | |

* cited by examiner

*Primary Examiner*—Allen Flanigan
(74) *Attorney, Agent, or Firm*—Sughrue Mion, PLLC

(57) ABSTRACT

A widthwise one half portion of a core section 5*a* is constituted by a first section 20 formed by stacking a plurality of first elements having first and second linear channels 34 and 35 inside them and fins, and a widthwise other half portion thereof is similarly constituted by a second section 21 formed by stacking a plurality of second elements respectively having U-shaped channels 46 inside them and fins. The number of times the refrigerant fed into a thicknesswise one half portion on an inlet tank 47 side of the first section 20 is turned back in an opposite direction concerning a longitudinal direction of the first linear channels 34 inside this thicknesswise one half portion is made more numerous than the number of times the refrigerant fed into a thicknesswise other half portion on an outlet tank 52 side of the first section 20 is turned back in the opposite direction concerning the longitudinal direction of the second linear channels 35 inside this thicknesswise other half portion.

16 Claims, 8 Drawing Sheets

STACKED-TYPE EVAPORATOR

BACKGROUND OF THE INVENTION

1. Field of the Invention

The present invention relates to a stacked-type evaporator incorporated in an air-conditioner, particularly an air-conditioner for an automobile to cool air for air-conditioning the air inside a vehicle compartment.

2. Description of the Related Art

An evaporator, for evaporating a refrigerant to cool the air flowing over it, is incorporated in an air-conditioner for an automobile. As such an evaporator incorporated in the air-conditioner for an automobile, a so-called stacked-type evaporator is conventionally known which is constructed by stacking together a plurality of metal plates, as known in JP-A-62-798, JP-A-7-12778U, and JP-A-9-318195. This stacked-type evaporator is constructed by stacking together a plurality of heat transfer tube elements each formed by combining two metal plates in the form of a peapod. FIGS. 8 and 9 show a stacked-type evaporator having the structure disclosed in JP-A-9-318195 mentioned above.

This evaporator 1 is arranged such that a plurality of heat transfer tube elements 3 each having two flat independent channels 2 inside it are provided as metal plates in which two metal plates each having a recessed portion on a respective one surface thereof are set as a set and are superposed in the form of a peapod with their recessed portions aligned with each other, and are joined to each other airtightly and fluid-tightly. A core section 5 is formed by stacking the plurality of heat transfer tube elements 3 with fins 4 provided between adjacent ones of the heat transfer tube elements 3. In addition, first and second outer members 6 and 7 each formed by superposing a side plate and a metal plate are respectively disposed on widthwise both end portions of the core section 5 with the fins 4 interposed between the respective outer member and the outermost heat transfer tube element 3. Further, a plurality of tank portions 8 to 10 are formed by allowing adjacent ones of tank spaces provided in upper and lower end portions of the channels 2 inside the heat transfer tube elements 3, excluding some tank spaces, to communicate with each other. In addition, a side tank portion 11 for allowing two tank portions 8 of the plurality of tank portions 8 to 10 to communicate with each other is provided at one widthwise end portion (a left end portion in FIGS. 8 and 9) of the core section 5. This side tank portion 11 is formed inside the first outer member 6 provided at one widthwise end of the core section 5. In addition, an inlet-side passage 12 communicating with the inlet tank portion 9 and an outlet-side passage 13 communicating with the outlet tank portion 10 are respectively formed inside the second outer member 7 provided at the other widthwise end (a right end in FIGS. 7 and 8) of the core section 5. Further, a refrigerant feeding pipe 14 and a refrigerant fetching pipe 17 are connected to a portion of the second outer member 7 in a state of communication with the inlet-side passage 12 and the outlet-side passage 13, respectively.

When the evaporator 1 is used, the refrigerant in a liquid state or in a gas-liquid mixed state which has been fed into the inlet tank portion 9 through a refrigerant feeding port 15 provided in the refrigerant feeding pipe 14 is made to flow through the channels 2 making up the core section 5, and the refrigerant is evaporated in the core section 5, thereby lowering the temperate of the core section 5. At that time, the refrigerant circulated in the core section 5 is also circulated in the side tank portion 11. Further, as the air for air-conditioning is made to flow in the direction of arrow a in FIG. 9 with respect to the thicknesswise direction of the core section 5, this air is cooled. In addition, the gaseous refrigerant which evaporated in the core section 5 is fetched from the outlet tank portion 10 to the outside through a refrigerant fetching port 16 provided in the refrigerant fetching pipe 17, and is fed to an unillustrated compressor. Meanwhile, in the case of the stacked-type evaporator disclosed in JP-A-9-318195 mentioned above, the number of times (three times) the refrigerant fed into a thicknesswise one half portion (a front-side half portion in FIG. 9) the core section 5 where the inlet tank portion 9 is present is turned back in an opposite direction concerning the vertical direction through the tank portions 8 and 9 provided in this thicknesswise one half portion is made more numerous than the number of times (one time) the refrigerant fed into a thicknesswise other half portion (a back-side half portion in FIG. 9) of the core section 5 where the outlet tank portion 10 is present is turned back in the opposite direction concerning the vertical direction through the tank portions 8 provided in this thicknesswise other half portion.

In the case of the stacked-type evaporator disclosed in JP-A-9-318195 mentioned above in which heat exchange is effected between the refrigerant flowing inside the core section 5 and the air passing over outer portions of the core section 5 to effect the air, it is possible to increase the flow rate of the refrigerant in the thicknesswise one half portion of the core section 5 on the inlet tank portion 9 side where the liquid refrigerant flows in a large quantity inside it. For this reason, even under the condition where the cooling load is small, the refrigerant in a gas-liquid mixed state flowing in the thicknesswise one half portion of the core section 5 can be made difficult to be separated into a gaseous state and a liquid state in this thicknesswise one half portion. At the same time, the non-uniform flow distribution of the refrigerant in this thicknesswise one half portion can be made difficult to occur, and the pressure loss can be reduced to some extent. In contrast, in the thicknesswise other half portion of the core section 5 on the outlet tank portion 10 side where the gaseous refrigerant flows in a large quantity inside it, the number of the channels 2 where the refrigerant is distributed from the respective tank portions 8 is made numerous. Accordingly, the increase in the pressure loss based on the fact that the gaseous refrigerant flows in a large quantity inside the thicknesswise other half portion of the core section 5 can be suppressed to a low level.

In the case of the structure disclosed in JP-A-9-318195 mentioned above, there is a possibility that the performance of the evaporator 1 cannot be sufficiently ensured without rendering the evaporator 1 large in size. Namely, with the above-described conventional evaporator 1, the side tank portion 11 is provided at one widthwise end of the core section 5, and since the arrangement provided is such that all the refrigerant fed into the thicknesswise one half portion of the core section 5 flows inside the side tank portion 11, the pressure loss inside this side tank portion 11 possibly becomes large. In contrast, it is conceivable to reduce the pressure loss in the side tank portion 11 by making the cross-sectional area of the side tank portion 11 sufficiently large. This arrangement, however, causes the evaporator 1 to become large in size, so that it is not preferable.

SUMMARY OF THE INVENTION

In view of the above-described circumstances, the invention has been made to realize a structure that is compact and capable of sufficiently ensuring the performance.

In the same way as the conventionally known stacked-type evaporator, the stacked-type evaporator includes a core section formed such that two metal plates each having a recessed portion on a respective one surface thereof are set as a set and are superposed in the form of a peapod with their recessed portions aligned with each other, and are joined to each other airtightly and fluid-tightly so as to form each of a plurality of heat transfer tube elements each having flat channels inside it for allowing a refrigerant to flow therethrough, and the plurality of heat transfer tube elements are stacked with fins provided between adjacent ones of the heat transfer tube elements; a refrigerant feeding port for feeding the refrigerant into the core section; and a refrigerant fetching port for fetching the refrigerant from inside the core section. The stacked-type evaporator is used in a state in which the refrigerant is circulated in the heat transfer tube elements making up the core section, and air for air-conditioning is made to pass over outer portions of the heat transfer tube elements concerning a thicknesswise direction of the core section.

In particular, in the stacked-type evaporator of the invention, at least a widthwise portion of the core section is constructed by superposing in the widthwise direction a first section formed by stacking a plurality of first elements with the fins provided between adjacent ones of the first elements and a second section formed by stacking a plurality of second elements with the fins provided between adjacent ones of the second elements.

As each pair of first metal plates each having first and second deep recessed portions provided in a mutually independent state at a longitudinal one end portion of its respective one surface, third and fourth deep recessed portions similarly provided in a mutually independent state at a longitudinal other end portion of its respective one surface, a first shallow recessed portion similarly provided in its intermediate portion to allow the first and third deep recessed portions to communicate with each other, and a second shallow recessed portion similarly provided in its intermediate portion to allow the second and fourth deep recessed portions to communicate with each other are superposed in the form of the peapod with the first deep recessed portions opposed to each other and are jointed together, each of the first elements making up the first section is provided with a first tank space formed in a portion where corresponding ones of the first deep recessed portions are butted against each other, a second tank space formed in a portion where corresponding ones of the second deep recessed portions are butted against each other, a third tank space formed in a portion where corresponding ones of the third deep recessed portions are butted against each other, a fourth tank space formed in a portion where corresponding ones of the fourth deep recessed portions are butted against each other, a first linear channel formed in a portion where corresponding ones of the first shallow recessed portions are butted against each other so as to allow the first and third tank spaces to communicate with each other, and a second linear channel formed in a portion where corresponding ones of the second shallow recessed portions are butted against each other so as to allow the second and fourth tank spaces to communicate with each other.

Further, as each pair of second metal plates each having fifth and sixth deep recessed portions provided in a mutually independent state at a longitudinal one end portion of its respective one surface and a third shallow recessed portion similarly provided in its intermediate portion and turned up midway by 180 degrees to allow the fifth and sixth deep recessed portions to communicate with each other are superposed in the form of the peapod with mutually corresponding ones the deep recessed portions opposed to each other and are jointed together, each of the second elements making up the second section is provided with a fifth tank space formed in a portion where corresponding ones of the fifth deep recessed portions are butted against each other, a sixth tank space formed in a portion where corresponding ones of the sixth deep recessed portions are butted against each other, and a U-shaped channel formed in a portion where corresponding ones of the third shallow recessed portions are butted against each other so as to allow the fifth and sixth tank spaces to communicate with each other.

Furthermore, a plurality of tank portions are formed by causing adjacent ones of the first to sixth tank spaces, excluding some tank spaces, to communicate with each other in a state in which the first section made up of the first elements and the second section made up of the second elements are superposed.

In addition, the refrigerant, which has been fed into a thicknesswise one half portion of the core section through the refrigerant feeding port, flows through a portion of the plurality of tank portions, the first linear channels, and one half side portions of the U-shaped channels, which are respectively present in the thicknesswise one half portion of the core section, subsequently flows through a remaining portion of the plurality of tank portions, the second linear channels, and another side half portions of the U-shaped channels, which are respectively present in a thicknesswise other half portion of the core section, and is fetched from the refrigerant fetching port. The number of times the refrigerant fed into a thicknesswise one half portion of the first section which is present in the thicknesswise one half portion of the core section is turned back in an opposite direction concerning a longitudinal direction of the first linear channels inside the thicknesswise one half portion of the first section is made more numerous than the number of times the refrigerant fed into a thicknesswise other half portion of the first section is turned back in the opposite direction concerning the longitudinal direction of the second linear channels inside the thicknesswise other half portion of the first section.

In accordance with the stacked-type evaporator of the invention constructed as described above, it is possible to reduce the number of the first linear channels where the refrigerant is distributed from a portion of the plurality of tanks portions inside the thicknesswise one half portion of the first section making up a part of the core section. For this reason, since the flow rate of the refrigerant flowing through the first linear channels can be increased, the non-uniform flow distribution of the refrigerant between these first linear channels can be made difficult to occur, thereby making it possible to cool the thicknesswise one half portion of the first section substantially uniformly. In addition, the thicknesswise one half portion of the first section and the thicknesswise other half portion of the first section overlap with each other with respect to the flowing direction of the air for air-conditioning. Accordingly, even in a case where the temperature difference between the respective portions becomes large due to the fact that the degree of the non-uniform flow distribution of the refrigerant has become considerably large in the thicknesswise other half portion of the first section, or even if practically all the portions of the second linear channels provided in the thicknesswise other half portion are formed as superheat regions where the refrigerant with a high dryness fraction flows therethrough, it is possible to reduce the possibility that relatively high-temperature portions or relatively low-temperature portions overlap with each other with respect to the flowing direction of the air. For this reason, the temperature distribution of the air after passage over the core section can be made substantially uniform, so that a pleasant cooled state can be realized for an occupant of the vehicle.

Furthermore, in accordance with the invention, since the non-uniform flow distribution of the refrigerant in the thicknesswise one half portion of the first section can be made difficult to occur, it is possible to reduce the pressure loss and improve the performance of the evaporator. Moreover, since the number of the second linear channels where the refrigerant is distributed in the thicknesswise other half portion of the first section can be increased, it is possible to suppress to a low level an increase in the pressure loss based on the fact that a large quantity of gaseous refrigerant flows through these second linear channels. Further, the thicknesswise one half portion and the thicknesswise other half portion of the core section can be made to communicate with each other by means of the plurality of U-shaped channels provided inside the second section. For this reason, it becomes unnecessary to provide a side tank which can cause a rise in the pressure loss, so that it is possible to reduce the pressure loss further without enlarging the evaporator, thereby making it possible to ensure sufficient performance. Further, in accordance with the invention, as for the kinds of the elements making up the core section, only two kinds are used, so that a reduction of cost can be attained.

BRIEF DESCRIPTION OF THE DRAWINGS

FIGS. 4A and 4B are diagrams illustrating a first metal plate for making up a first element shown in FIG. 2A, in which FIG. 4A is a view taking in the direction of arrow a in FIG. 1 and FIG. 4B is a view taken in the same direction as in FIG. 2A.

FIGS. 5A and 5B are diagrams illustrating a second metal plate for making up a second element shown in FIG. 2B, in which FIG. 5A is a view taking in the direction of arrow a in FIG. 1 and FIG. 5B is a view taken in the same direction as in FIG. 2B.

DETAILED DESCRIPTION OF THE PRESENT INVENTION

Figure 1:
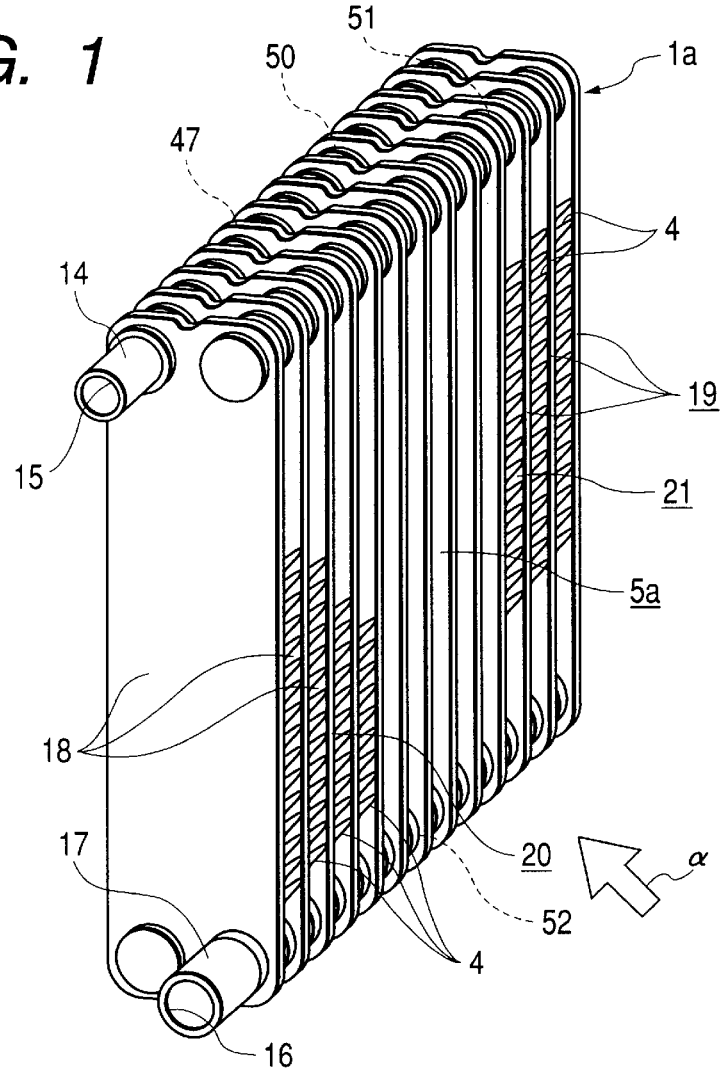
FIG. 1 is a perspective view illustrating a first embodiment of the invention.
Figure 2A:
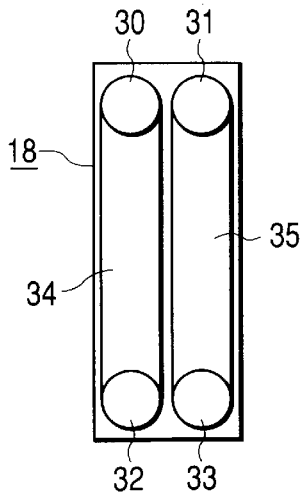
FIGS. 2A and 2B are schematic diagrams respectively illustrating two kinds of elements making up an evaporator of the invention, as viewed from the left-hand side direction in FIG. 1.
Figure 2B:
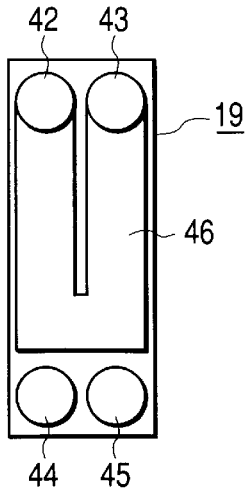
Figure 3:
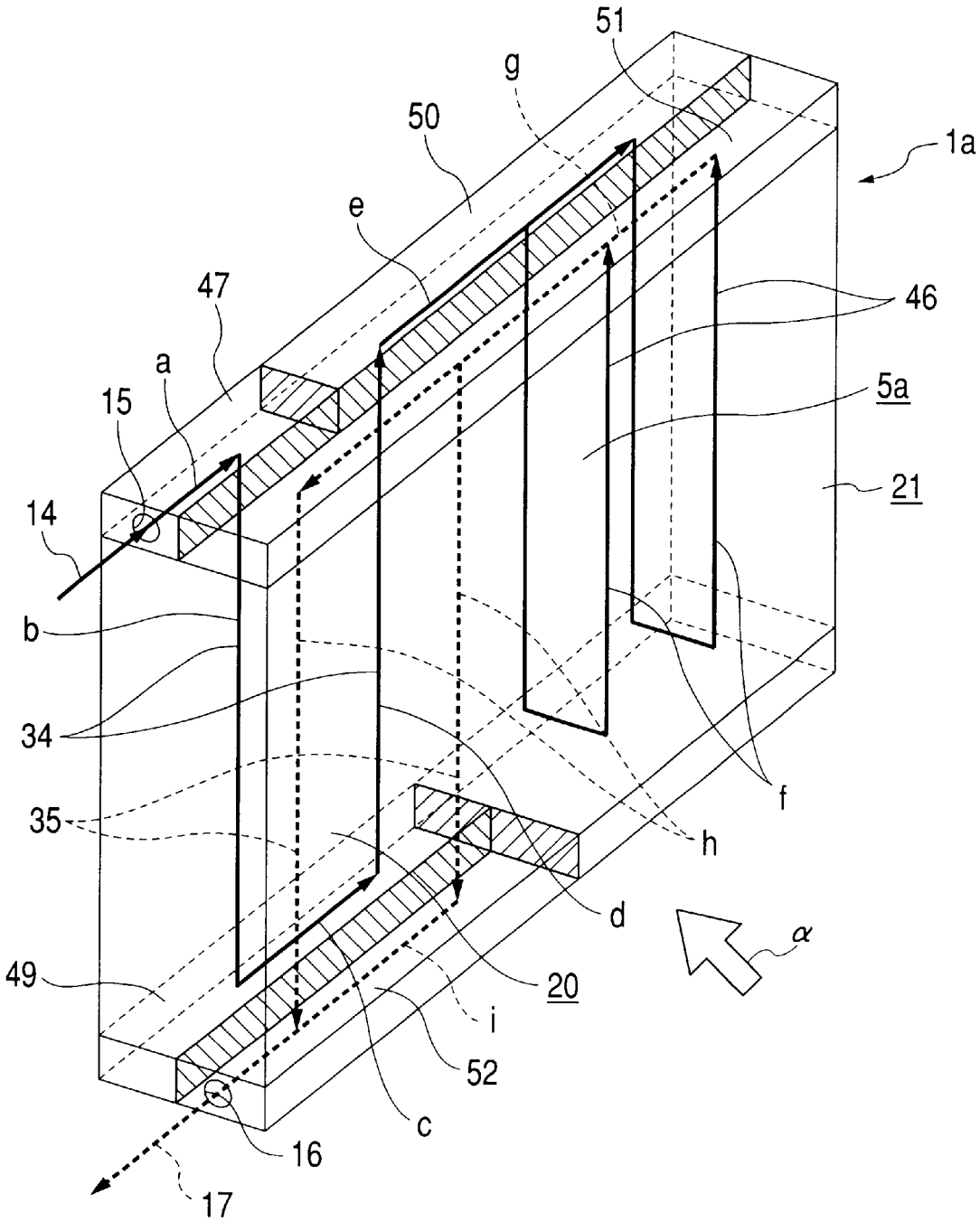
FIG. 3 is a schematic perspective view for explaining the state of flow of a refrigerant in the evaporator of the invention.

FIGS. 1 to 6 illustrate an embodiment of the invention. An evaporator 1*a* of the invention has a core section 5*a* which is formed by stacking a plurality of first elements 18, a plurality of second elements 19, and a plurality of corrugated-type fins 4. A widthwise one half portion (a left half portion in FIGS. 1, 3, and 6) of the core section 5*a* is constituted by a first section 20 formed by stacking the plurality of first elements 18 in a state in which the fins 4 are provided between adjacent ones of the first elements 18. Similarly, a widthwise other half portion (a right half portion in FIGS. 1, 3, and 6) of the core section 5*a* is constituted by a second section 21 formed by stacking the plurality of second elements 19 in a state in which the fins 4 are provided between adjacent ones of the second elements 19. In addition, the first elements 18 and the second elements 19 are fabricated such that two first metal plates 22 and two second metal plates 23 having recessed portions on one surfaces thereof are respectively set as sets, are superposed in the form of a peapod with their recessed portions facing each other, and are joined to each other airtightly and fluid-tightly. The first elements 18 and the second elements 19 have flat channels for allowing a refrigerant to flow through their interiors. In addition, the internal structures of the aforementioned first and second elements 18 and 19 are made mutually different.

The aforementioned first and second metal plates 22 and 23 are formed as so-called double-sided clad metals in which a brazing metal (an aluminum alloy which contains a large quantity of Si and has a relatively low melting point) is laminated on both surfaces of a core metal (an aluminum alloy having a relatively high melting point). In the case where the evaporator 1*a* is fabricated, the aforementioned first and second metal plates 22 and 23, the fins 4, a refrigerant feeding pipe 14 having a refrigerant feeding port 15, and a refrigerant fetching pipe 17 having a refrigerant fetching port 16 are combined and are heated in a heating furnace, and the respective members 22, 23, 4, 14, and 17 are joined together by brazing by using the aforementioned brazing metal. In this state, the widthwise one half portion of the core section 5*a* is formed as the first section 20 in which the plurality of first elements 18 and the fins 4 are superposed, and similarly the widthwise other half portion is formed as the second section 21 in which the plurality of second elements 19 and the fins 4 are superposed.

Figure 4A:
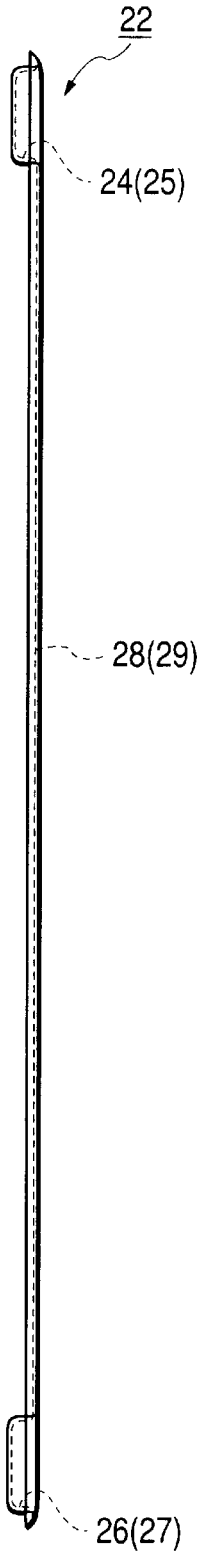
Figure 4B:
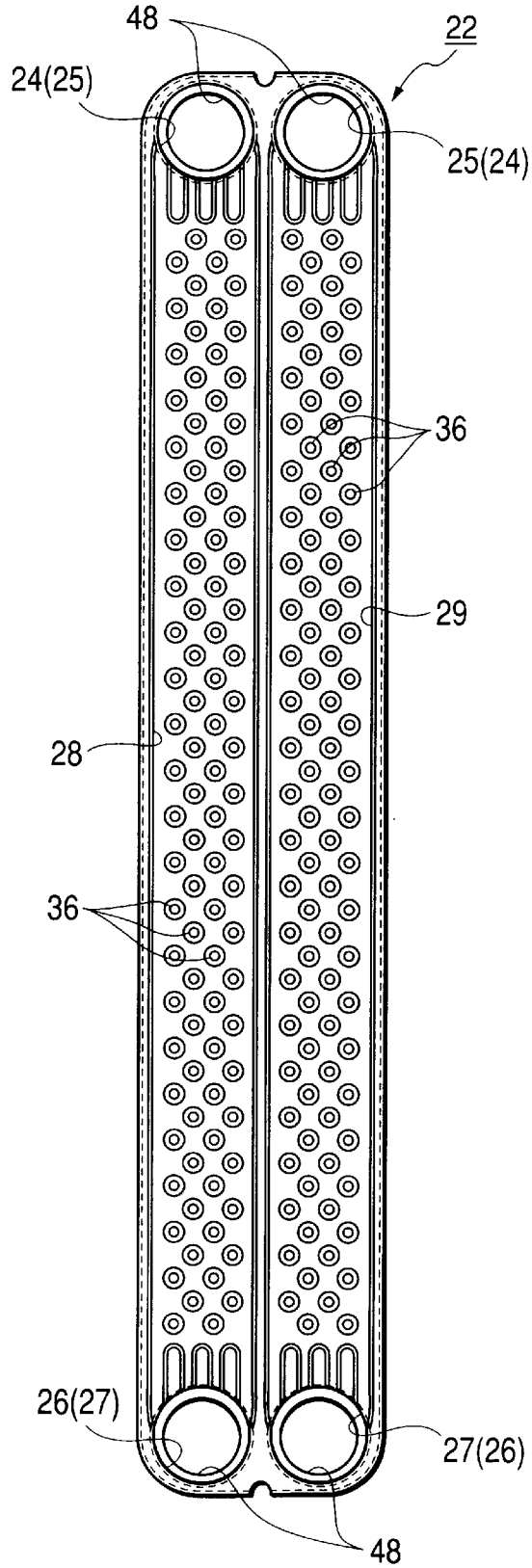

Each of the first elements 18 making up the first section 20 of the core section 5*a* is arranged such that two plates of the first metal plates 22 such as the one shown in detail in FIGS. 4A and 4B are superposed in the form of a peapod with their recessed portions facing each other, and are brazed as a unit. Each of the aforementioned first metal plates 22, which are each formed by subjecting the raw plate, i.e., the double-sided clad metal made of an aluminum alloy, to press working, has mutually independent first and second deep recessed portions 24 and 25 provided in an upper end portion of its respective one surface. Further, each of the first metal plates 22 has mutually independent third and fourth deep recessed portions 26 and 27 provided in a lower end portion of the respective one surface. Further, provided in its intermediate portion are a first shallow recessed portion 28 for allowing the first and third deep recessed portions 24 and 26 to communicate with each other and a second shallow recessed portion 29 provided independently from this first shallow recessed portion 28 for allowing the second and fourth deep recessed portions 25 and 27 to communicate with each other.

The first elements 18 are each formed such that the two first metal plates 22 such as those described above and serving as a pair are superposed in the form of a peapod with their recessed portions facing each other, i.e., in a state in which the mutually corresponding ones of the first deep recessed portions 24, the second deep recessed portions 25, the third deep recessed portions 26, the fourth deep recessed portions 27, the first shallow recessed portions 28, and the second shallow recessed portions 29 are opposed to each other. Further, a first tank space 30 is formed in the portion where the mutually corresponding first deep recessed portions 24 butted against each other, a second tank space 31 is formed in the portion where the mutually corresponding second deep recessed portions 25 butted against each other, a third tank space 32 is formed in the portion where the mutually corresponding third deep recessed portions 26 butted against each other, and a fourth tank space 33 is formed in the portion where the mutually corresponding fourth deep recessed portions 27 butted against each other.

In addition, the portion where the mutually corresponding first shallow recessed portions 28 butted against each other is formed as a first linear channel 34 to allow the first and third tank spaces 30 and 32 to communicate with each other. Further, the portion where the mutually corresponding second shallow recessed portions 29 butted against each other is formed as a second linear channel 35 to allow the second and fourth tank spaces 31 and 33 to communicate with each other. It should be noted that a multiplicity of projections 36 are formed on the first and second shallow recessed portions 28 and 29. When the pair of first metal plates 22 are combined in the form of a peapod, distal end faces of these projections 63 are butted and brazed together, together with peripheral edge portions of the first metal plates 22 and intermediate portions between the first and second shallow recessed portions 28 and 29. These projections 63 serve to secure the compressive strength of the first elements 18 and disturb the flow of the refrigerant flowing through the first and second linear channels 34 and 35.

Figure 5A:
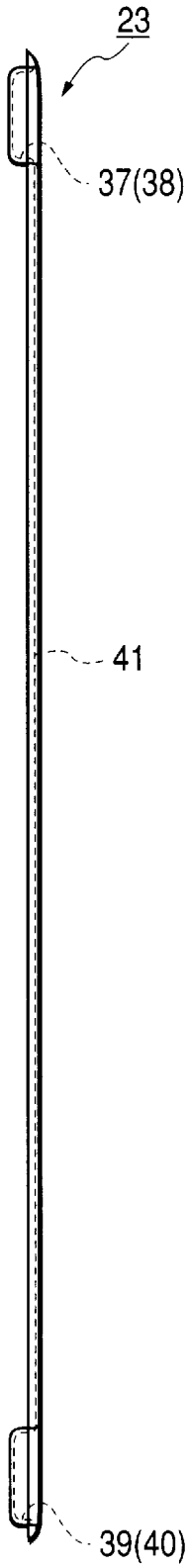
Figure 5B:
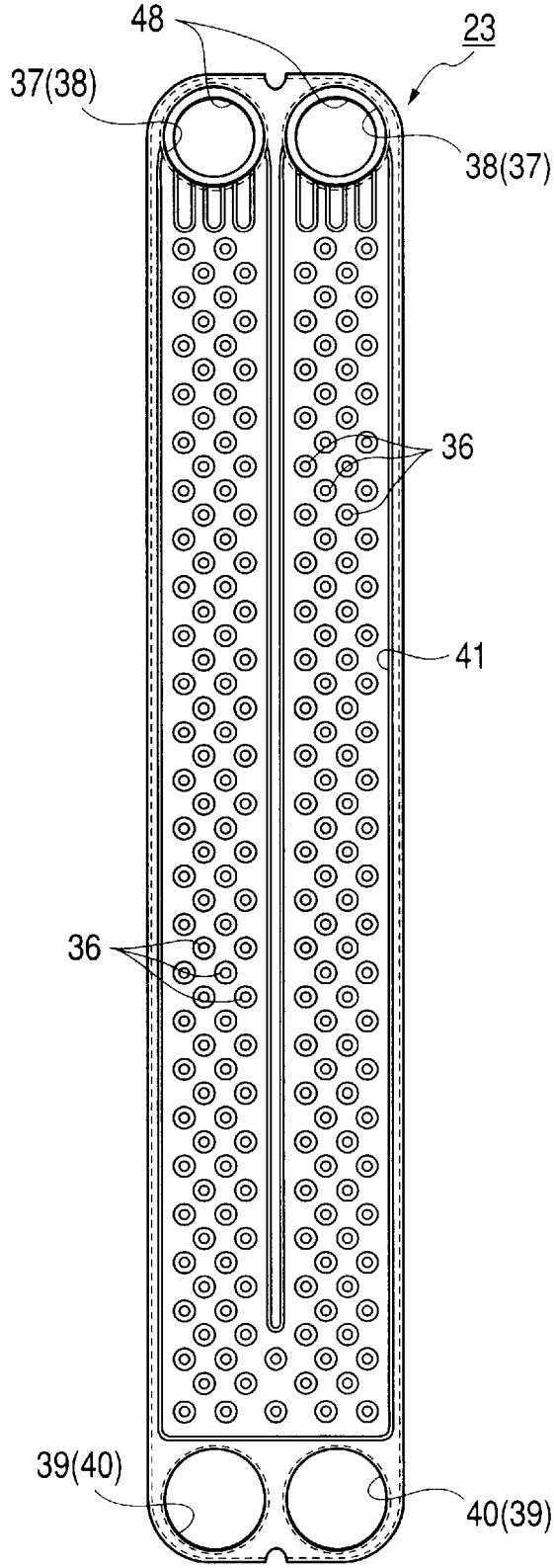
Figure 6:
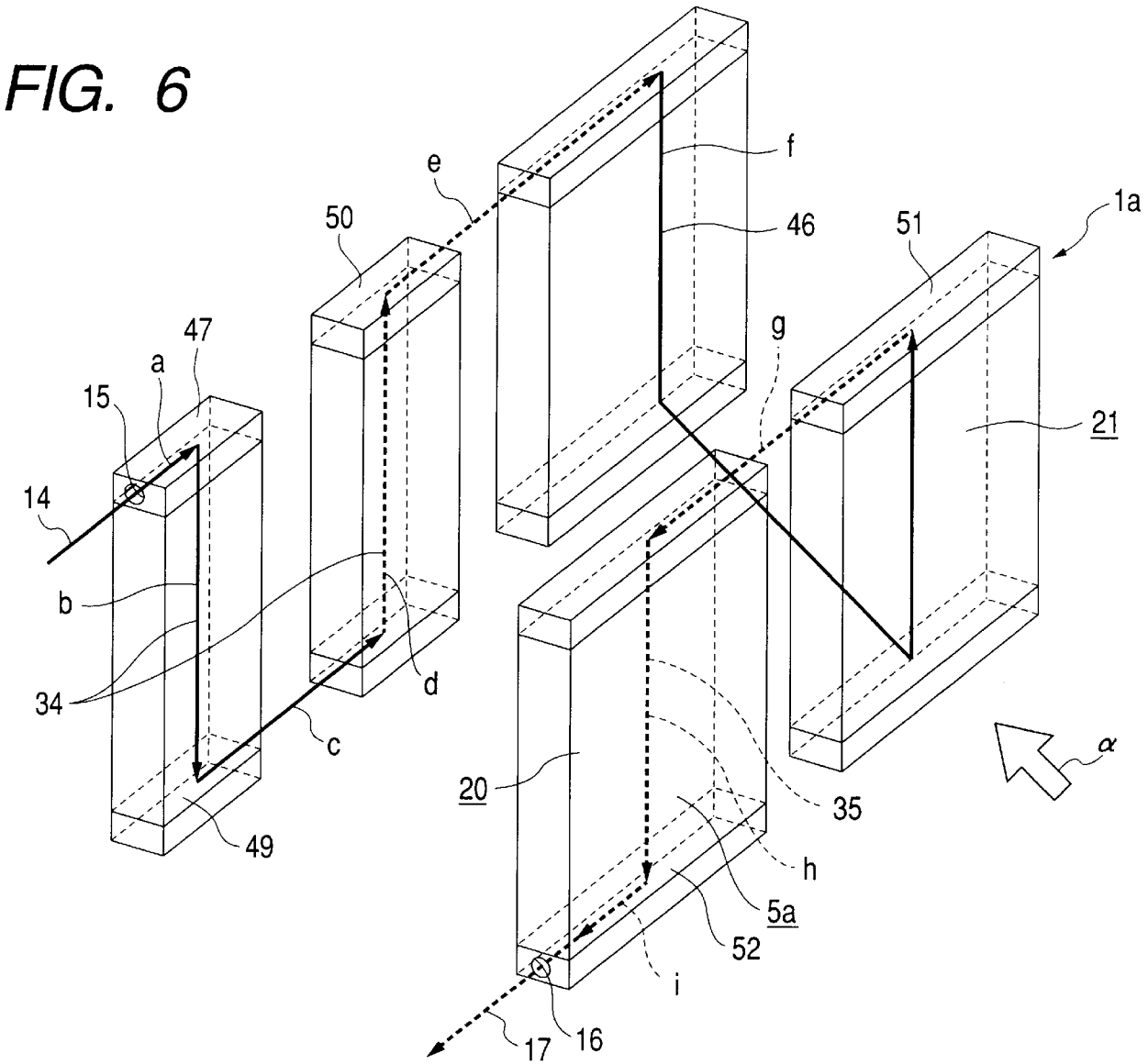
FIG. 6 is a schematic perspective view of a state in which the evaporator of the invention is partially separated, for explaining the state of flow of the refrigerant in the evaporator of the invention.

Meanwhile, each of the second elements 19 making up the second section 21 of the core section 5*a* is arranged such that two plates of the second metal plates 23 such as the one shown in detail in FIGS. 5A and 5B are superposed in the form of a peapod, and are brazed together. Each of the aforementioned metal plates 23, which are similarly each formed by subjecting the raw plate, i.e., the double-sided clad metal made of an aluminum alloy, to press working, has mutually independent fifth and sixth deep recessed portions 37 and 38 provided in an upper end portion of its respective one surface. Further, each of the second metal plates 23 has mutually independent seventh and eighth deep recessed portions 39 and 40 provided in a lower end portion of the respective one surface. Further, provided in its intermediate portion is a third shallow recessed portion 41 which is turned up midway by 180 degrees to allow the fifth and sixth deep recessed portions 37 and 38 to communicate with each other.

The second elements 19 are each formed such that the two second metal plates 23 such as those described above and serving as a pair are superposed in the form of a peapod with their recessed portions facing each other, i.e., in a state in which the mutually corresponding ones of the fifth deep recessed portions 37, the sixth deep recessed portions 38, the seventh deep recessed portions 39, the eighth deep recessed portions 40, and the third shallow recessed portions 41 are opposed to each other. Further, a fifth tank space 42 is formed in the portion where the mutually corresponding fifth deep recessed portions 37 butted against each other, a sixth tank space 43 is formed in the portion where the mutually corresponding sixth deep recessed portions 38 butted against each other, a seventh tank space 44 is formed in the portion where the mutually corresponding seventh deep recessed portions 39 butted against each other, and an eighth tank space 45 is formed in the portion where the mutually corresponding eighth deep recessed portions 40 butted against each other. In addition, the portion where the mutually corresponding third shallow recessed portions 41 butted against each other is formed as a U-shaped channel 46 to allow the fifth and sixth tank spaces 42 and 43 to communicate with each other. It should be noted that the multiplicity of projections 36 are also formed on the third shallow recessed portion 41 in the same way as the first and second shallow recessed portions 28 and 29 provided on the above-described first metal plate 22.

The core section 5*a* is formed by mutually superposing the first section 20 comprised of the plurality of first elements 18 respectively formed as described above and the fins 4 as well as the second section 21 comprised of the plurality of second elements 19 respectively formed as described above and the fins 4 in a state in which the fins 4 are provided between the first section 20 and the second section 21. Further, the second linear channels 35 in the first elements 18 and downstream-side half portions of the U-shaped channels 46 in the second elements 19 are located on the windward side, while the first linear channels 34 in the first elements 18 and upstream-side half portions of the U-shaped channels 46 in the second elements 19 are located on the leeward side.

Further, in a state in which the first elements 18 and the second elements 19 are thus stacked in the above-described manner, the first tank spaces 30 of the first elements 18 making up a widthwise one half portion (a left half portion in FIGS. 1, 3, and 6) of the first section 20 on the side away from the second section 21 are made to communicate with each other, thereby forming an inlet tank portion 47. For this reason, through holes 48 for allowing the refrigerant to flow therethrough are formed in bottoms of the first deep recessed portions 24 formed in the first metal plates 22 making up the first elements 18 in the widthwise one half portion of the first section 20, excluding one first metal plate 22 located at a widthwise other end (a right end in FIGS. 1, 3, and 6) of the widthwise one half portion of the first section 20. A downstream end of the refrigerant feeding pipe 14 is connected to one longitudinal end (a left end in FIGS. 1, 3, and 6) of the inlet tank portion 47 thus constructed.

In addition, a return tank portion 49 is formed by causing the third tank spaces 32 of the first elements 18 making up the first section 20 to communicate with each other. For this reason, the through holes 48 for allowing the refrigerant to flow therethrough are formed in bottoms of the third deep recessed portions 26 formed in the first metal plates 22 making up the first elements 18 of the first section 20, excluding one first metal plate 22 located at one longitudinal end of the first section 20.

In addition, the first tank spaces 30 of the first elements 18 making up a widthwise other half portion (a right half portion in FIGS. 1, 3, and 6) of the first section 20 on the side close to the second section 21 and the fifth tank spaces 42 of the second elements 19 making up the second section 21 are made to communicate with each other, thereby forming an upstream-side refrigerant transfer tank portion 50. For this reason, through holes 48 for allowing the refrigerant to flow therethrough are formed in bottoms of the first deep recessed portions 24 formed in the first metal plates 22 making up the widthwise other half portion of the first section 20 and in bottoms of the sixth deep recessed portions 38 formed in the second metal plates 23 making up the second section 21, excluding one second metal plate 23 located at a widthwise other end (a right end in FIGS. 1, 3, and 6) of the second section 21.

In addition, the sixth tank spaces 43 of the second elements 19 making up the second section 21 and as the second tank spaces 31 of the first elements 18 making up the first section 20 are made to communicate with each other, thereby forming a downstream-side refrigerant transfer tank portion 51. For this reason, through holes 48 for allowing the refrigerant to flow therethrough are formed in bottoms of the sixth deep recessed portions 38 formed in the second metal plates 23 making up the second section 21 and in bottoms of the second deep recessed portions 25 formed in the first metal plates 22 making up the first section 20, excluding one second metal plate 23 located at the widthwise other end of the second section 21 and one first metal plate 22 located at the widthwise one end of the first section 20.

Further, the fourth tank spaces 33 of the first elements 18 making up the first section 20 are made to communicate with each other, thereby forming an outlet tank portion 52. For this reason, through holes 48 for allowing the refrigerant to flow therethrough are formed in bottoms of the fourth deep recessed portions 27 formed in the first metal plates 223 making up the first section 20. An upstream end of the refrigerant feeding pipe 14 is connected to one longitudinal end (a left end in FIGS. 1, 3, and 6) of the outlet tank portion 52 thus constructed. The number of times (one time) the refrigerant fed into the thicknesswise one half portion (the back-side half portion in FIGS. 1, 3, and 6) on the inlet tank 47 side of the first section 20 is turned back in the opposite direction concerning the longitudinal direction of the first linear channels 34 inside this thicknesswise one half portion is made more numerous than the number of times (zero time) the refrigerant fed into the thicknesswise other half portion (the front-side half portion in FIGS. 1, 3, and 6) on the outlet tank 52 side of the first section 20 is turned back in the opposite direction concerning the longitudinal direction of the second linear channels 35 inside this thicknesswise other half portion.

It should be noted that, in this embodiment, the third tank spaces 32 of the first elements 18 making up the first section 20 and the seventh tank spaces 44 of the second elements 19 making up the second section 21 are not made to communicate with each other, and mutually adjacent ones of the seventh tank spaces 44 are not made to communicate with each other. In addition, the fourth tank spaces 33 of the first elements 18 making up the first section 20 and the eighth tank spaces 45 of the second elements 19 making up the second section 21 are not made to communicate with each other, and mutually adjacent ones of the eights tank spaces 45 are not made to communicate with each other. For this reason, through holes which penetrate both side surfaces are not formed in the bottoms of the seventh deep recessed portions 39 and the bottoms of the eighth deep recessed portions 40 formed in the second metal plates 23 making up the second elements 19. Accordingly, in the case of this embodiment, these seventh deep recessed portions 39 and eighth deep recessed portions 40 may be omitted. However, in the case of this embodiment, opposite side portions of the seventh deep recessed portions 39 and opposite side portions of the eighth deep recessed portions 40 which are made to abut against each other between lower end portions of the mutually adjacent second elements 19 are respectively brazed so as to sufficiently secure the rigidity of the second section. Accordingly, in the case where the seventh deep recessed portions 39 and the eighth deep recessed portions 40 are omitted, in view of securing rigidity it is preferable to adopt a different means for joining the lower end portions of the second heat transfer tube elements 19. In addition, by forming through holes in the bottoms of the seventh deep recessed portions 39 and in the bottoms of the eighth deep recessed portions 40, the third tank spaces 32 of the first elements 18 and the seventh tank spaces 44 may be made to communicate with each other, and the fourth tank spaces 33 of the first elements 18 and the eighth tank spaces 45 of the second elements 19 may be made to communicate with each other, as required.

When the stacked-type evaporator of the invention constructed as described above is used, the refrigerant in a liquid state or in a gas-liquid mixed state which was discharged from a condenser and passed an expansion valve is fed from the refrigerant feeding pipe 14 into the inlet tank portion 47. As shown by solid-line arrow a in FIGS. 3 and 6, the refrigerant fed into this inlet tank portion 47 spreads in the entire inlet tank portion 47. Subsequently, as shown by solid-line arrow b in the drawing, the refrigerant which spread in the inlet tank portion 47 flows toward the return tank portion 49 through the first linear channels 33 in the first elements 18, which make up the leeward widthwise one half portion of the first section 20 provided in the widthwise one half portion of the core section 5*a*, while effecting heat transfer with the air flowing in the direction of arrow a in the drawing.

As shown by solid-line arrow c in the drawing, the refrigerant which thus flowed into the return tank portion 49 flows in the horizontal direction through the return tank portion 49, i.e., through the lower end portion of the leeward portion of the first section 20, and then flows into the first linear channels 34 provided in the leeward portion of the widthwise other half portion of the first section 20. As shown by solid-line arrow d in the drawing, the refrigerant which flowed into the first linear channels 34 flows upward from below while effecting the heat exchange, and then reaches the upstream-side refrigerant transfer tank portion 50 where the refrigerant flows as shown by solid-line arrow e in the drawing. Then, the refrigerant which flowed out from the upstream-side refrigerant transfer tank portion 50 flows into the U-shaped channels 46 of the second section 21 provided in the widthwise other half portion of the core section 5*a*. As shown by solid-line arrow f in the drawing, the refrigerant which flowed into the U-shaped channels 46 flows downward from above through the leeward portion of the second section 21 while effecting the heat exchange, then returns 180 degrees at the lower end portion, flows upward from below through the windward portion of the second section 21, and reaches the downstream-side refrigerant transfer tank portion 51.

As shown by solid-line arrow g in the drawing, the refrigerant which reached the downstream-side refrigerant transfer tank portion 51 flows through the downstream-side refrigerant transfer tank portion 51, and then flows into the second linear channels 35 provided in the first elements 18 making up the first section 20. As shown by solid-line arrow h in the drawing, the refrigerant which flowed into the second linear channels 35 flows downward from above through the windward portion of the first section 20 while effecting the heat exchange, and then reaches the outlet tank portion 52. Then, as shown by solid-line arrow i in the drawing, the gaseous refrigerant in a superheated state flows through this outlet tank portion 52, flows out to the refrigerant fetching pipe 17, and is fed to an inlet port of a compressor through the piping connected to a downstream end of this refrigerant fetching pipe 17.

In accordance with the stacked-type evaporator of the invention which is constructed as described above and effects heat exchange between the refrigerant flowing through the core section 5*a* and the air flowing over the outer portions of the core section 5*a* as described above to cool the air, it is possible to ensure sufficient performance with a compact structure. Namely, in the case of the evaporator 1*a* of the invention, since the refrigerant fed into the thicknesswise one half portion of the first section 20 making up the widthwise one half portion of the core section 5*a* is turned back in the opposite direction concerning the longitudinal direction of the first linear channels 34 inside this thicknesswise one half portion, it is possible to reduce the number of the first linear channels 34 where the refrigerant is distributed from the inlet tank portion 47 or the return tank portion 49 in the thicknesswise one half portion of the first section 20. For this reason, since the flow rate of the refrigerant flowing through the first linear channels 34 can be increased, the non-uniform flow distribution of the refrigerant between these first linear channels 34 can be made difficult to occur, thereby making it possible to cool the thicknesswise one half portion of the first section 20 substantially uniformly. In addition, the thicknesswise one half portion of the first section 20 and the thicknesswise other half portion of the first section 20 overlap with each other with respect to the flowing direction of the air for air-conditioning. Accordingly, even in a case where the temperature difference between the respective portions becomes large due to the fact that the degree of the non-uniform flow distribution of the refrigerant has become considerably large in the thicknesswise other half portion of the first section 20, or even if practically all the portions of the second linear channels 35 provided in the thicknesswise other half portion are formed as superheat regions where the refrigerant with a high dryness fraction flows therethrough, it is possible to reduce the possibility that relatively high-temperature portions or relatively low-temperature portions overlap with each other with respect to the flowing direction of the air. For this reason, the temperature distribution of the air after passage over the core section 5*a* can be made substantially uniform, so that a pleasant cooled state can be realized for the occupant of the vehicle.

Furthermore, in accordance with the invention, since the non-uniform flow distribution of the refrigerant in the thicknesswise one half portion of the first section 20 can be made difficult to occur, it is possible to reduce the pressure loss and improve the performance of the evaporator 1*a*. Moreover, since the number of the second linear channels 35 where the refrigerant is distributed in the thicknesswise other half portion of the first section 20 can be increased, it is possible to suppress to a low level an increase in the pressure loss based on the fact that a large quantity of gaseous refrigerant flows through these second linear channels 35. Further, the thicknesswise one half portion and the thicknesswise other half portion of the core section 5*a* can be made to communicate with each other by means of the plurality of U-shaped channels 46 provided inside the second section 21. For this reason, it becomes unnecessary to provide a side tank which can cause a rise in the pressure loss, so that it is possible to reduce the pressure loss further without enlarging the evaporator 1*a*, thereby making it possible to ensure sufficient performance.

Further, in accordance with the invention, as for the kinds of the elements 18 and 19 making up the core section 5*a*, only two kinds are used. For this reason, parts manufacture, parts management, and assembly operation are all facilitated, so that a reduction of the cost of the evaporator 1*a* can be attained. Furthermore, in the case of this embodiment, the thicknesswise other half portion of the core section 5*a* which is a relatively high temperature side is disposed on the windward side, whereas the thicknesswise one half portion of the core section 5*a* which is a relatively low temperature side is disposed on the leeward side. Accordingly, the temperature difference between the core section 5*a* and the air passing through the core section 5*a* can be sufficiently secured from the windward side to the leeward side, thereby allowing heat exchange between the core section 5*a* and the air to be effected efficiently.

Figure 7:
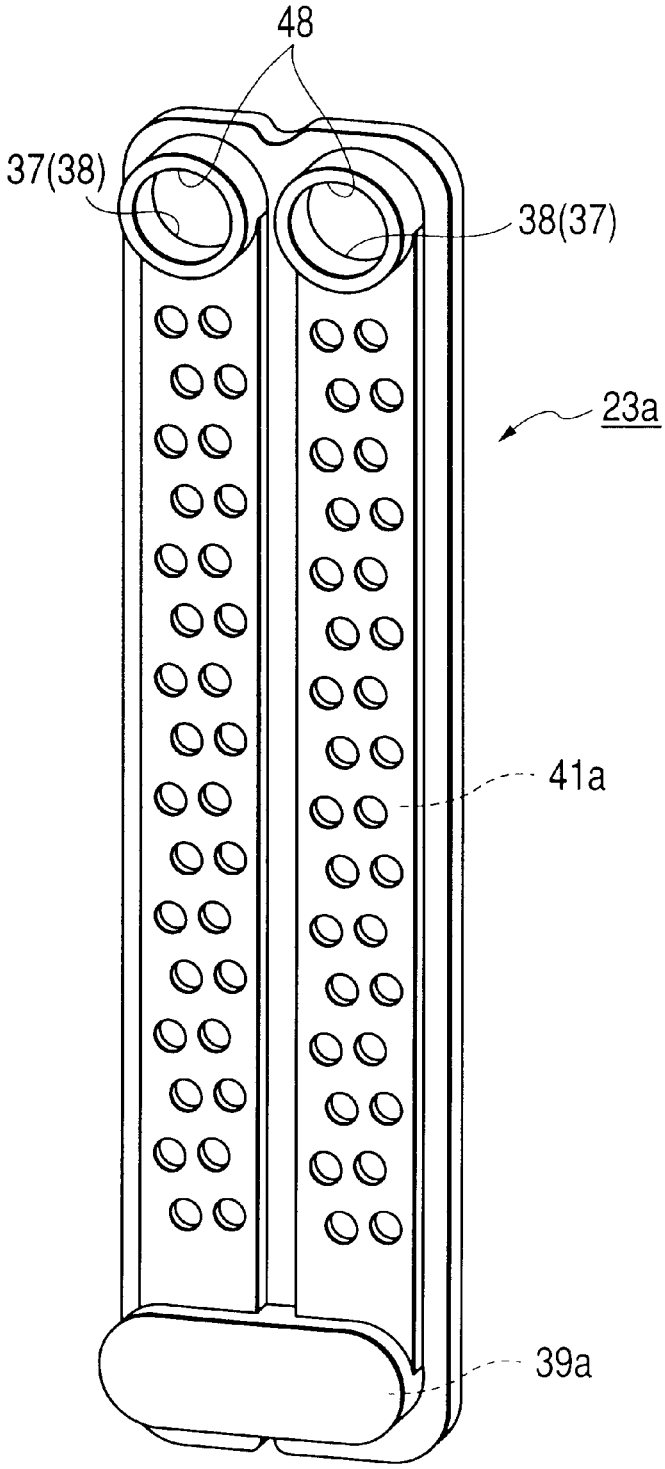
FIG. 7 is a diagram illustrating another example of the second metal plate for making up the second element and corresponding to one which is viewed from the opposite side to the one shown in FIG. 5B.
Figure 8:
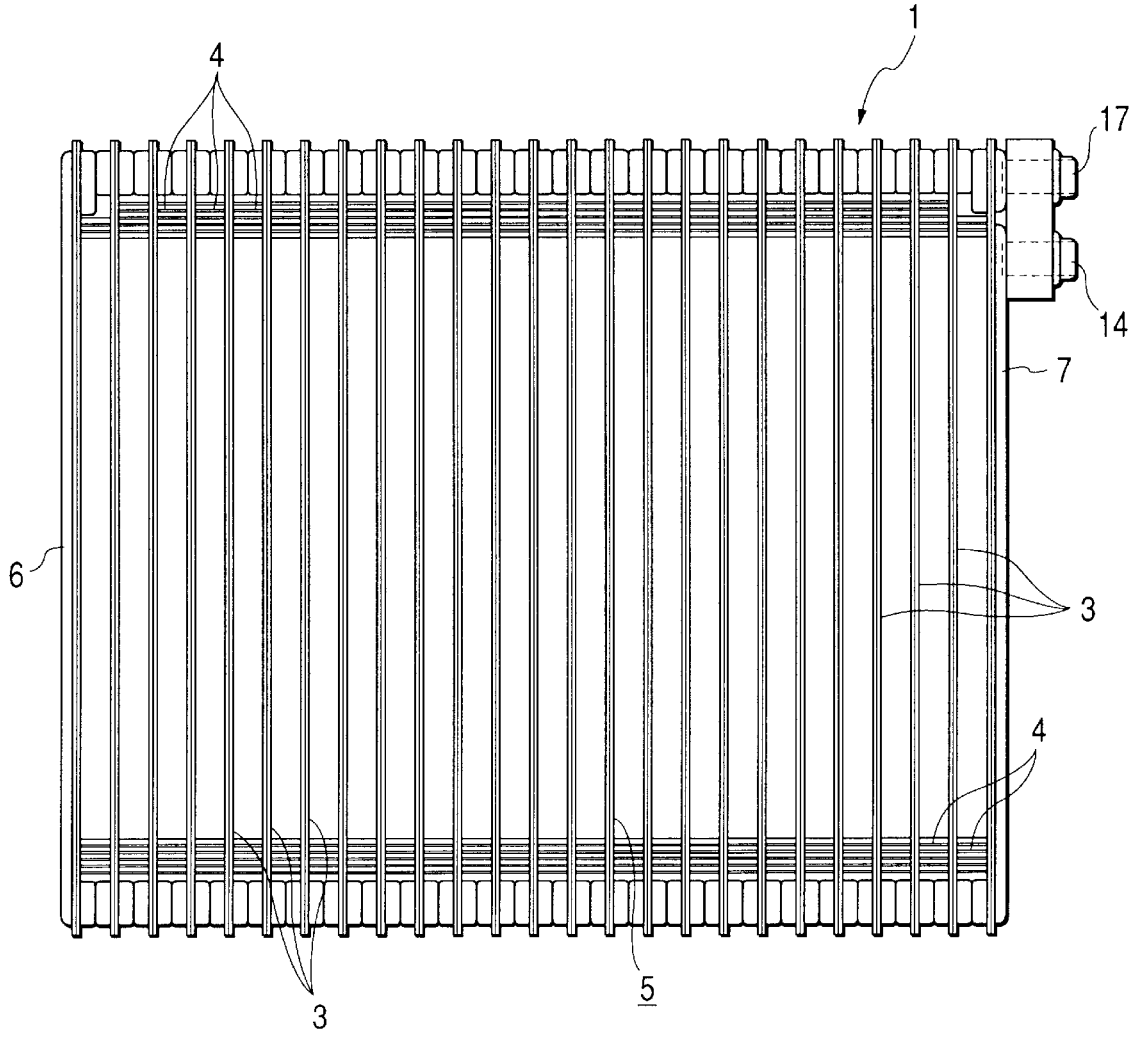
FIG. 8 is a front elevational view illustrating one example of a conventional structure.
Figure 9:
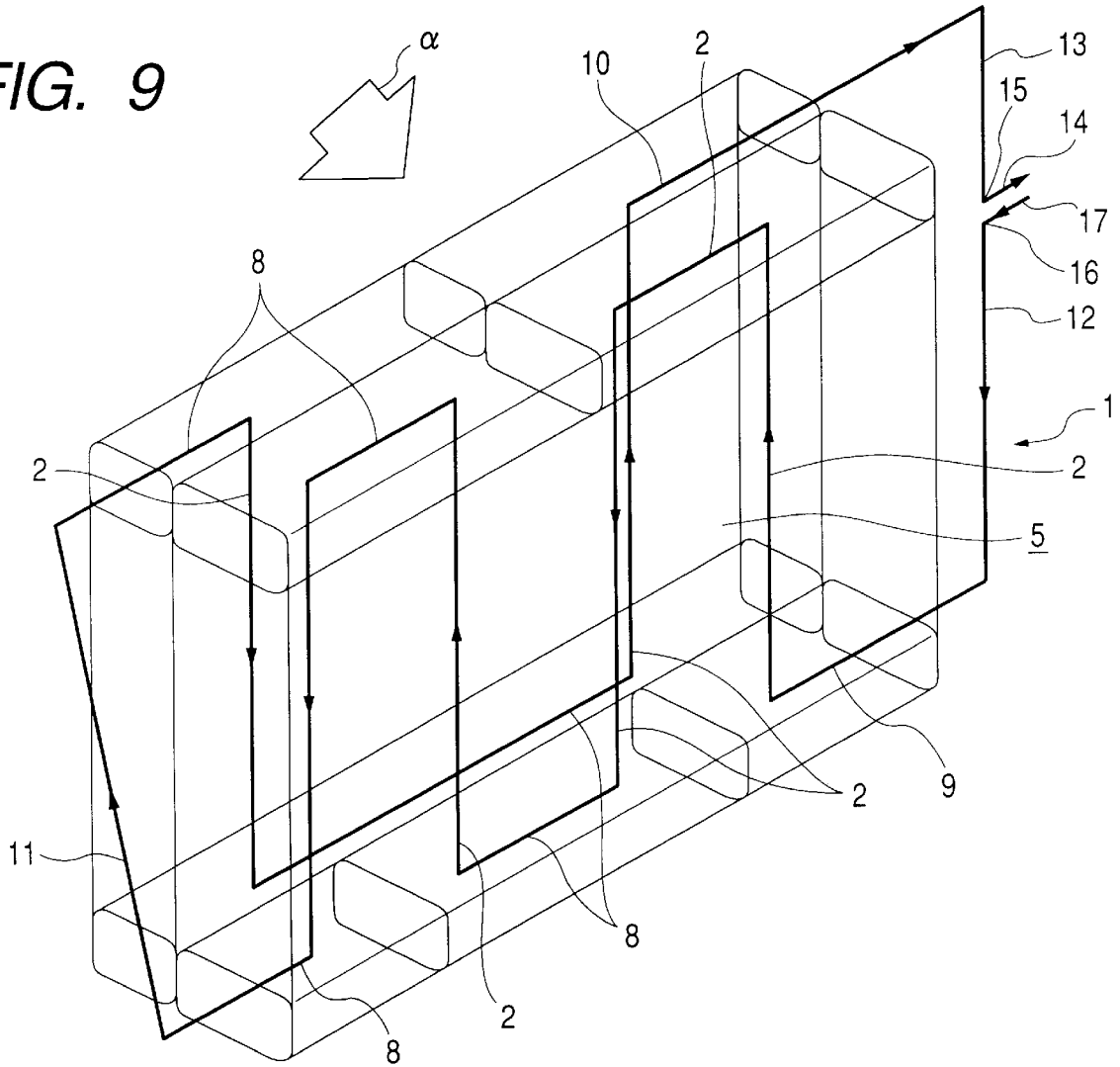
FIG. 9 is a schematic perspective view for explaining the state of flow of the refrigerant in the example of the conventional structure.

It should be noted that the second section which is disposed on the widthwise other side portion of the core section may be constructed b using the fins 4 and a plurality of second elements which, unlike the case of the above-described first embodiment, are each formed by superposing two second metal plates 23*a* each having the shape such as the one shown in FIG. 7. Further, in the case of the second metal plate 23*a* shown in FIG. 7, a seventh deep recessed portion 39*a* is formed in a lower end portion of a third shallow recessed portion 41*a* in a state in which the seventh deep recessed portion 39*a* communicates with the third shallow recessed portion 41*a*. As the two second metal plates 23*a* thus constructed as a pair are superposed in the form of a peapod in a state in which the mutually corresponding third shallow recessed portions 41*a* and the mutually corresponding seventh deep recessed portions 39*a* are respectively opposed to each other, the second element having a U-shaped channel inside it is formed. Accordingly, in the case of the second element made up of the second metal plates 23*a*, the seventh tank space formed by the seventh deep recessed portions 39*a* forms a portion of the U-shaped channel, so that the length of the U-shaped channel formed inside it can be made large as compared with the case of the second element 19 used in the above-described first embodiment.

In addition, the number of times the refrigerant fed into the thicknesswise one half portion of the first section is turned back in the opposite direction concerning the longitudinal direction of the first linear channels inside this thicknesswise one half portion may be set to two or more times, or the number of times the refrigerant fed into the thicknesswise other half portion of the first section is turned back in the opposite direction concerning the longitudinal direction of the second linear channels inside this thicknesswise other half portion may be set to one or more times. In other words, in the invention, it suffices if the number of times the refrigerant fed into the thicknesswise one half portion of the first section is turned back in the opposite direction concerning the longitudinal direction of the first linear channels inside this thicknesswise one half portion is greater than the number of times the refrigerant fed into the thicknesswise other half portion of the first section is turned back in the opposite direction concerning the longitudinal direction of the second linear channels inside this thicknesswise other half portion.

Since the stacked-type evaporator of the invention is constructed and operates as described above, it is possible to ensure sufficient performance with a compact structure.

What is claimed is:

1. An evaporator comprising:

a plurality of heat transfer elements disposed in parallel;

a plurality of fins each sandwiched between the adjacent heat transfer elements, wherein the plurality of heat transfer elements defines:

a plurality of first tank spaces for passing a refrigerant;

at least a second tank space for passing the refrigerant;

at least a third rank space for passing the refrigerant, the third tank space positioned to oppose the first tank spaces;

at least a fourth rank space for passing the refrigerant, the fourth rank space positioned to oppose the second tank space;

a fifth tank space communicating with one of the first tank space;

a sixth tank space communicating with the second tank space;

a plurality of first straight passages each connecting the first tank space with the third tank space to pass the refrigerant;

a plurality of second straight passages each connecting the second tank space with the fourth tank space to pass the refrigerant;

a U-shaped passage for connecting the fifth rank space with the sixth tank space;

a refrigerant input for introducing the refrigerant into one of the first tank spaces; and a refrigerant out put for exhausting the refrigerant from the fourth tank space;

wherein said first straight passages are formed into two or more sets defining at least two passes, such that the refrigerant flows hum the first tank space to the third tank space through a first set of first straight passages, and then reverses direction from said third tank space back to said first tank space through a second set of first straight passages.

2. The evaporator as claimed in claim 1, wherein the first tank spaces, the third tank space, and the fifth tank space are arranged in a first plane; and the second tank space, the fourth tank space, and the sixth tank space are arranged in a second plane.

3. The evaporator as claimed in claim 1, wherein the first plane and the second plane are disposed in parallel with each other.

4. The evaporator as claimed in claim 1, wherein the fifth tank space is defined adjacent to the sixth tank space.

5. The evaporator as claimed in claim 1, wherein the first tank spaces are arranged with the fifth tank space in straight.

6. The evaporator as claimed in claim 1, wherein the second tank space is arranged with the sixth tank space in straight.

7. The evaporator as claimed in claim 1, wherein the refrigerant flows from one of the first tank space to the fourth tank space, through one of the first straight passage, the third tank, another of the first straight passage, another of the first tank space, the fifth tank space, the U-shaped line, the sixth tank space, the second tank space and the second straight passage in order.

8. The evaporator as claimed in claim 1, wherein the plurality of heat transfer elements includes:

a plurality of first elements arranged in parallel; and a plurality of second elements arranged in parallel and disposed on one of the first elements with one of the fins sandwiched there between.

9. The evaporator us claimed in claim 8, wherein each of the first elements includes a pair of first metal plates having a first deep recessed portion and second deep recessed portion at one end of the first metal plates, and a third deep recessed portion and fourth deep recessed portion at the other end of the first metal plates.

10. The evaporator as claimed in claim 9, wherein the pair of first metal plates are interposed and joined to each other airtightly and fluid-tightly.

11. The evaporator as claimed in claim 10, wherein:

the first deep recessed portion communicates with the adjacent first deep recessed portions to form the first tank space;

the second deep recessed portion communicates with the adjacent second deep recessed portions to form the second tank space;

the third deep recessed portion communicates with the adjacent third deep recessed portions to form the third tank space;

the fourth deep recessed portion communicates with the adjacent fourth deep recessed portions to form the fourth tank space.

12. The evaporator as claimed in claim 9, wherein each of the first metal plates defines:

a first shallow recessed portion communicating the first deep recessed portion with the third deep recessed portion to form the first straight passage; and a second stud low recessed portion communication the second deep recessed portion with the fourth deep recessed portion to form the second straight passage.

13. The evaporator as claimed in claim 8, wherein each of the second elements includes a pair of second metal plates having a fifth deep recessed portion and sixth deep recessed portion at one end of the second metal plate.

14. The evaporator as claimed in claim 13, wherein the pair of second metal plates are interposed and joined to each other airtightly and fluid-tightly.

15. The evaporator as claimed in claim 14, wherein:

the fifth deep recessed portion communicates with the adjacent fifth deep recessed portions to form the fifth tank space; and the sixth deep recessed portion communicates with the adjacent sixth deep recessed portions to form the sixth tank space.

16. The evaporator as claimed in claim 14, wherein each of the second metal plates defines a third shallow recessed portion connecting the fifth deep recessed portion with the sixth deep recessed portion to form the U-shaped passage, and the U-shaped passage is folded back by 180° at the other end of the second metal plate.

* * * * *